US007244194B2

(12) United States Patent
Sullivan

(10) Patent No.: US 7,244,194 B2
(45) Date of Patent: Jul. 17, 2007

(54) THICK INNER COVER MULTI-LAYER GOLF BALL

(75) Inventor: Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/469,025

(22) Filed: Aug. 31, 2006

(65) Prior Publication Data

US 2006/0287134 A1 Dec. 21, 2006

Related U.S. Application Data

(63) Continuation-in-part of application No. 11/267,487, filed on Nov. 4, 2005, now Pat. No. 7,150,687, which is a continuation of application No. 10/841,031, filed on May 7, 2004, now Pat. No. 7,004,856.

(51) Int. Cl.
*A63B 37/06* (2006.01)

(52) U.S. Cl. ..... 473/373

(58) Field of Classification Search ..... 473/373, 473/374, 367, 376, 368
See application file for complete search history.

(56) References Cited

U.S. PATENT DOCUMENTS

| | | | |
|---|---|---|---|
| 3,262,272 | A | 7/1966 | Barakauskas et al. |
| 4,431,193 | A | 2/1984 | Nesbitt |
| 5,028,674 | A | 7/1991 | Hatch et al. |
| 5,306,760 | A | 4/1994 | Sullivan |
| 5,368,304 | A | 11/1994 | Sullivan et al. |
| 5,484,870 | A | 1/1996 | Wu |
| 5,688,191 | A | 11/1997 | Cavallaro et al. |
| 5,692,974 | A | 12/1997 | Wu et al. |
| 5,779,561 | A | 7/1998 | Sullivan et al. |
| 5,803,831 | A | 9/1998 | Sullivan et al. |
| 5,885,172 | A | 3/1999 | Hebert et al. |
| 5,902,855 | A | 5/1999 | Sullivan |
| 5,919,100 | A | 7/1999 | Boehm et al. |
| 5,984,806 | A | 11/1999 | Sullivan et al. |
| 6,015,356 | A | 1/2000 | Sullivan et al. |
| 6,083,119 | A | 7/2000 | Sullivan et al. |
| 6,117,024 | A | 9/2000 | Dewanjee |
| 6,126,559 | A | 10/2000 | Sullivan et al. |
| 6,132,324 | A | 10/2000 | Hebert et al. |
| 6,142,887 | A | 11/2000 | Sullivan et al. |
| 6,152,834 | A | 11/2000 | Sullivan |
| 6,187,864 | B1 | 2/2001 | Rajagopalan |
| 6,220,972 | B1 | 4/2001 | Sullivan et al. |
| 6,232,400 | B1 | 5/2001 | Harris et al. |
| 6,244,977 | B1 | 6/2001 | Sullivan et al. |
| 6,245,862 | B1 | 6/2001 | Rajagopalan |
| 6,287,217 | B1 | 9/2001 | Sullivan et al. |
| 6,290,611 | B1 | 9/2001 | Rajagopalan et al. |
| 6,309,314 | B1 | 10/2001 | Sullivan et al. |
| 6,355,715 | B1 | 3/2002 | Ladd et al. |
| 6,419,595 | B1 | 7/2002 | Maruko |
| 6,435,987 | B1 | 8/2002 | Dewanjee |
| 6,443,858 | B2 | 9/2002 | Bartels et al. |
| 6,478,697 | B2 | 11/2002 | Yagley et al. |
| 6,508,968 | B1 | 1/2003 | Bulpett et al. |
| 6,592,470 | B2 | 7/2003 | Watanabe et al. |
| 6,602,941 | B2 | 8/2003 | Higuchi et al. |
| 6,626,771 | B2 | 9/2003 | Watanabe |
| 6,635,716 | B2 | 10/2003 | Voorheis et al. |
| 6,653,382 | B1 | 11/2003 | Statz et al. |
| 6,659,887 | B2 | 12/2003 | Watanabe |
| 6,667,001 | B2 * | 12/2003 | Sullivan et al. ..... 264/129 |
| 6,672,976 | B2 | 1/2004 | Watanabe |
| 6,756,436 | B2 | 6/2004 | Rajagopalan et al. |
| 6,761,648 | B2 | 7/2004 | Takesue et al. |
| 6,786,839 | B2 | 9/2004 | Hayashi et al. |
| 6,824,478 | B2 | 11/2004 | Hayashi et al. |
| 6,838,501 | B2 | 1/2005 | Takesue et al. |
| 6,875,132 | B2 | 4/2005 | Hayashi et al. |
| 6,894,097 | B2 | 5/2005 | Takesue et al. |
| 6,953,820 | B2 | 10/2005 | Statz et al. |
| 6,966,850 | B2 | 11/2005 | Watanabe et al. |
| 7,066,836 | B2 | 6/2006 | Hayashi |
| 2002/0045498 | A1 | 4/2002 | Watanabe et al. |
| 2003/0050373 | A1 | 3/2003 | Chen |
| 2003/0114565 | A1 | 6/2003 | Chen et al. |
| 2004/0162162 | A1 | 8/2004 | Simonutti et al. |
| 2005/0159247 | A1 | 7/2005 | Lemons et al. |
| 2005/0182192 | A1 | 8/2005 | Takesue et al. |

FOREIGN PATENT DOCUMENTS

| | | |
|---|---|---|
| WO | WO 00/23519 | 4/2000 |
| WO | WO 01/29129 | 4/2001 |

* cited by examiner

*Primary Examiner*—Raeann Trimiew
(74) *Attorney, Agent, or Firm*—William B. Lacy

(57) ABSTRACT

A golf ball including a core having a diameter of 0.5 inches to 1.4 inches, a compression of about 45 or less; and a coefficient of restitution of from 0.730 to 0.810; a cast polyurea cover; and an intermediate layer disposed between the core and the cover, the intermediate layer having a thickness of 0.11 inches or greater and being formed from a composition including a highly-neutralized acid polymer having a moisture vapor transmission rate of 8 g·mil/100 $in^2$/day or less; wherein a combination of the core and the intermediate layer results in a compression of from about 70 to about 100, and the golf ball has a coefficient of restitution of from 0.805 to 0.820 when measured at an incoming velocity of 125 ft/s and greater than 0.75 when measured at an incoming velocity of 160 ft/s, and a compression of from 75 to 105.

18 Claims, No Drawings

THICK INNER COVER MULTI-LAYER GOLF BALL

CROSS-REFERENCE TO RELATED APPLICATIONS

This application is a continuation-in-part of U.S. patent application Ser. No. 11/267,487 filed Nov. 4, 2005 now U.S. Pat. No. 7,150,687, which is a continuation of U.S. patent application Ser. No. 10/841,031, filed May 7, 2004 now U.S. Pat. No. 7,004,856.

FIELD OF THE INVENTION

This invention generally relates to golf balls with high coefficient of restitution and low deformation, and more particularly to also a high coefficient of restitution golf ball at high club speeds.

BACKGROUND OF THE INVENTION

Golf balls have been designed to provide particular playing characteristics. These characteristics generally include initial ball velocity, coefficient of restitution (COR), compression, weight distribution and spin of the golf ball, which can be optimized for various types of players.

Golf balls can generally be divided into two classes: solid and wound. Solid golf balls include single-layer, dual-layer (i.e., solid core and a cover), and multi-layer (i.e., solid core of one or more layers and/or a cover of one or more layers) golf balls. Wound golf balls typically include a solid, hollow, or fluid-filled center, surrounded by tensioned elastomeric thread, and a cover.

Generally, the hardness of a golf ball or a golf ball core is one among other factors used in designing golf balls. Typically, when a ball is hard, e.g., possessing high compression values and low deformation when struck by a club, it typically has high COR and high initial velocity after impact with a golf club. However, hard ball has a "hard" feel and is difficult to control around the greens. A softer ball, e.g., lower compression value and high deformation, has a "soft" feel and is easier to control with short iron clubs for greenside play. Recently developed solid balls have a core, at least one intermediate layer, and a cover. The intermediate layer improves other playing characteristics of solid balls, and can be made from thermoset or thermoplastic materials.

Recent advancements in golf ball design can produce golf balls with low compression for soft "feel" and high COR for long flight distance. The COR for low compression balls, however, decreases at higher impact speed with golf clubs.

Hence, there remains a need in the art for low compression golf balls that have high coefficient of restitution at low impact speeds and at high impact speeds.

SUMMARY OF THE INVENTION

Definitions

The following terms that are used in this application are defined in terms of the enumerated ASTM tests: Specific Gravity ASTM D-792, Flexural Modulus ASTM D-790, Shore D Hardness ASTM D-2240, and Shore C Hardness ASTM D-2240. The ASTM D-792 test was carried out in lab conditions where the temperature was controlled to 20-23° C.

As used herein, the terms "points" and "compression points" refer to the compression scale or the compression scale based on the ATTI Engineering Compression Tester. This scale, which is well known to those working in this field, is used in determining the relative compression of a core or ball. Compression is measured by applying a spring-loaded force to the golf ball center, golf ball core or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inches (5 mm) against this spring. If the spring, in turn, compresses 0.2 inches, the compression is rated at 100; if the spring compresses 0.1 inches, the compression value is rated as 0. Thus more compressible, softer materials will have lower Atti gauge values than harder, less compressible materials. Compression measured with this instrument is also referred to as PGA compression.

As used herein, "COR" refers to Coefficient of Restitution, which is obtained by dividing a ball's rebound velocity by its initial (i.e., incoming) velocity. This test is performed by firing the samples out of an air cannon at a vertical steel plate over a range of test velocities (from 75 to 150 ft/s). A golf ball having a high COR dissipates a smaller fraction of its total energy when colliding with the plate and rebounding therefrom than does a ball with a lower COR. Unless otherwise noted, the COR values reported herein are the values determined at an incoming velocity of 125 ft/s.

As used herein, the term "copolymer" refers to a polymer which is formed from two or more monomers, wherein the monomers are not identical.

As used herein, the term "terpolymer" refers to a polymer which is formed from three monomers, wherein the monomers are not identical.

As used herein, the term "fillers" includes any compound or composition that can be used to vary the density and other properties of the subject golf ball cores.

As used herein, the term "pph" in connection with a batch formulation refers parts by weight of the constituent per hundred parts of the base composition (e.g., elastomer).

As used herein, the term "Mooney viscosity" refers to the unit used to measure the plasticity of raw or unvulcanized rubber. The plasticity in a Mooney unit is equal to the torque, measured on an arbitrary scale, on a disk in a vessel that contains rubber at a temperature of 100° C. and rotates at two revolutions per minute. The measurement of Mooney viscosity is defined according to ASTM D-1646.

The term "about," as used herein in connection with one or more numbers or numerical ranges, should be understood to refer to all such numbers, including all numbers in a range.

DETAILED DESCRIPTION OF THE PREFERRED EMBODIMENTS

The golf balls of the present invention may comprise any of a variety of constructions, such as a two-piece, three-piece, multi-layer, or wound ball having a variety of cores, intermediate layers, covers, and coatings. The covers and cores of the present invention include structures comprising one or more layers. Cores may include a single, unitary layer, comprising the entire core from the center of the core to its outer periphery, or may contain a center surrounded by at least one outer core layer. The center, the innermost portion of the core, is preferably solid, but may be hollow or liquid-, gel-, or gas-filled. The outer core layer may also be a wound layer formed of a tensioned elastomeric material. Cover layers of the present invention may also contain one or more layers, such as a double cover comprising an inner and outer cover layer. Optionally, an intermediate layer disposed between the core and cover may be incorporated. The intermediate layer, if present, may comprise one or more layers, and are sometimes referred to in the art, and, thus, herein as well, as inner cover layers, outer core layers, or mantle layers.

In accordance to the present invention, a golf ball is provided with a low compression and high COR layer, which is supported or otherwise reinforced by a low deformation layer. Preferably, the low compression, high COR layer is made from a polymer composition including a halogenated thiophenol compound. Such rubber and halogenated thiophenol composition is fully disclosed in U.S. Pat. No. 6,635,716, the disclosure of which is hereby incorporated by reference in its entirety.

The preferred core composition comprises a base rubber compound, a co-reaction agent, a filler, an optional halogenated thiophenol compound, and a co-crosslinking or initiator agent.

The base rubber compound typically includes natural or synthetic rubbers. A preferred base rubber is 1,4-polybutadiene having a cis-structure of at least 40%, more preferably at least about 90%, and most preferably at least about 95%. Most preferably, the base rubber comprises high-Mooney-viscosity rubber. Preferably, the base rubber has a Mooney viscosity greater than about 35, more preferably greater than about 50. Preferably, the polybutadiene rubber has a molecular weight greater than about 400,000 and a polydispersity of no greater than about 2. A common indicator of the degree of molecular weight distribution of a polymer is its polydispersity, defined as the ratio of weight average molecular weight, $M_w$, to number average molecular weight, $M_n$. Polydispersity ("dispersity") also provides an indication of the extent to which the polymer chains share the same degree of polymerization. If the polydispersity is 1.0, then all polymer chains must have the same degree of polymerization. Since $M_w$ is always equal to or greater than $M_n$, polydispersity, by definition, is equal to or greater than 1.0. Such rubber compounds are commercially available from Bayer of Akron, Ohio, UBE Industries of Tokyo, Japan, and Shell of Houston, Tex., among others. The base rubber may also be mixed with other elastomers known in the art such as natural rubber, polyisoprene rubber and/or styrene-butadiene rubber in order to modify the properties of the core.

Suitable co-reaction agents include a metal salt of diacrylate, dimethacrylate or monomethacrylate. Preferably, the co-reaction agent is zinc diacrylate (ZDA) and is present in the amount from about 5 to about 40 and more preferably from about 5 to about 30 and most preferably from about 10 to about 20 parts per one-hundred parts of rubber compound (phr). Suitable cross-linking agents include any known polymerization initiator, which decomposes during the cure cycle. Such initiators include, but are not limited to, organic peroxide compounds such as dicumyl peroxide. In its pure form, the preferred amount of peroxide is between about 0.25 phr and about 2.5 phr. Any filler can be used in any desired quantity to alter a property of the core, including specific weight, flexural modulus, moment of inertia, theological properties, among others. Suitable fillers include, but are not limited to, tungsten, zinc oxide, barium sulfate, silica, metal oxides, ceramic and fibers.

The polybutadiene rubber compositions of the present invention may, optionally, contain a halogenated thiophenol compound. The halogenated thiophenol is preferably present in an amount of 0.01 pph to about 5 pph, more preferably about 2.2 pph to about 5 pph, most preferably about 2.3 pph to 4 pph. The halogenated thiophenol compound may include pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodotbiophenol; 2,3,5,6-tetraiodothiophenoland; and their zinc salts, the metal salts thereof, and mixtures thereof. Preferably, the preferred halogenated thiophenol is pentachlorothiophenol or a metal salt thereof. The metal salt may be zinc, calcium, potassium, magnesium, sodium, and lithium, but is preferably zinc. Pentachlorothiophenol is commercially available from Strucktol Company of Stow, Ohio, and zinc pentachlorothiophenol is commercially available from eChinachem of San Francisco, Calif.

This preferred polybutadiene rubber composition may further include an α,β-unsaturated carboxylic acid or a metal salt thereof, an organic peroxide, and a filler. Also, as discussed in co-pending '448 patent application, another preferred polybutadiene rubber compound comprising the halogenated thiophenol compound is a mid Mooney viscosity polybutadiene having viscosity in the range of about 40 Mooney to about 60 Mooney.

The invention also relates to "modified" soft, resilient thermoplastic ionomers for use in golf ball intermediate layers, preferably thick intermediate layers disposed between the core and the cover. These "soft" ionomers typically comprise a melt blend of (a) the acid copolymers or the melt processible ionomers made therefrom as described above and (b) one or more organic acid(s) or salt(s) thereof, wherein greater than 80%, preferably greater than 90% of all the acid of (a) and of (b) is neutralized. Preferably, 100% of all the acid of (a) and (b) is neutralized by a cation source. Preferably, an amount of cation source in excess of the amount required to neutralize 100% of the acid in (a) and (b) is used to neutralize the acid in (a) and (b). Blends with fatty acids or fatty acid salts are preferred.

The organic acids or salts thereof are added in an amount sufficient to enhance the resilience of the copolymer. Preferably, the organic acids or salts thereof are added in an amount sufficient to substantially remove remaining ethylene crystallinity of the copolymer.

Preferably, the organic acids or salts are added in an amount of at least about 5% (weight basis) of the total amount of copolymer and organic acid(s). More preferably, the organic acids or salts thereof are added in an amount of at least about 15%, even more preferably at least about 20%. Preferably, the organic acid(s) are added in an amount up to about 50% (weight basis) based on the total amount of copolymer and organic acid. More preferably, the organic acids or salts thereof are added in an amount of up to about 40%, more preferably, up to about 35%. The non-volatile, non-migratory organic acids preferably are one or more aliphatic, mono-functional organic acids or salts thereof as described below, particularly one or more aliphatic, mono-functional, saturated or unsaturated organic acids having less than 36 carbon atoms or salts of the organic acids, preferably stearic acid or oleic acid. Fatty acids or fatty acid salts are most preferred.

Processes for fatty acid (salt) modifications are known in the art. Particularly, the modified highly-neutralized soft, resilient acid copolymer ionomers of this invention can be produced by:

(a) melt-blending (1) ethylene, a,β-ethylenically unsaturated $C_{3-8}$ carboxylic acid copolymer(s) or melt-processible ionomer(s) thereof that have their crystallinity disrupted by addition of a softening monomer or other means with (2) sufficient non-volatile, non-migratory organic acids to substantially enhance the resilience and to disrupt (preferably remove) the remaining ethylene crystallinity, and then concurrently or subsequently (b) Adding a sufficient amount of a cation source to increase the level of neutralization of all the acid moieties (including those in the acid copolymer and in the organic acid if the non-volatile, non-migratory organic acid is an organic acid) to the desired level.

The weight ratio of X to Y in the composition is at least about 1:20. Preferably, the weight ratio of X to Y is at least about 1:15, more preferably, at least about 1:10. Furthermore, the weight ratio of X to Y is up to about 1:1.67, more preferably up to about 1:2. Most preferably, the weight ratio of X to Y in the composition is up to about 1:2.2.

The acid copolymers used in the present invention to make the ionomers are preferably 'direct' acid copolymers (containing high levels of softening monomers). As noted above, the copolymers are at least partially neutralized, preferably at least about 40% of X in the composition is neutralized. More preferably, at least about 55% of X is neutralized. Even more preferably, at least about 70, and most preferably, at least about 80% of X is neutralized. In the event that the copolymer is highly neutralized (e.g., to at least 45%, preferably 50%, 55%, 70%, or 80%, of acid moiety), the MI of the acid copolymer should be sufficiently high so that the resulting neutralized resin has a measurable MI in accord with ASTM D-1238, condition E, at 190° C., using a 2160 gram weight. Preferably this resulting MI will be at least 0.1, preferably at least 0.5, and more preferably 1.0 or greater. Preferably, for highly neutralized acid copolymer, the MI of the acid copolymer base resin is at least 20, or at least 40, at least 75, and more preferably at least 150.

The acid copolymers preferably comprise a-olefin, particularly ethylene, $C_{3-8}$ a,β-ethylenically unsaturated carboxylic acid, particularly acrylic and methacrylic acid, and softening monomers, selected from alkyl acrylate, and alkyl methacrylate, wherein the alkyl groups have from 1-8 carbon atoms, copolymers. By "softening," it is meant that the crystallinity is disrupted (the polymer is made less crystalline). While the alpha olefin can be a $C_2$-$C_4$ alpha olefin, ethylene is most preferred for use in the present invention. Accordingly, it is described and illustrated herein in terms of ethylene as the alpha olefin.

The acid copolymers, when the α-olefin is ethylene, can be described as E/X/Y copolymers where E is ethylene, X is the a,β-ethylenically unsaturated carboxylic acid, and Y is a softening co-monomer X is preferably present in 2-30 (preferably 4-20, most preferably 5-15) wt. % of the polymer, and Y is preferably present in 17-40 (preferably 20-40, most preferably 24-35) wt. % of the polymer.

The ethylene-acid copolymers with high levels of acid (X) are difficult to prepare in continuous polymerizers because of monomer-polymer phase separation. This difficulty can be avoided however by use of "co-solvent technology" as described in U.S. Pat. No. 5,028,674, or by employing somewhat higher pressures than those which copolymers with lower acid can be prepared.

Specific acid-copolymers include ethylene/(meth) acrylic acid/n-butyl (meth) acrylate, ethylene/(meth) acrylic acid/iso-butyl (meth) acrylate, ethylene/(meth) acrylic acid/methyl (meth) acrylate, and ethylene/(meth) acrylic acid/ethyl (meth) acrylate terpolymers.

The organic acids employed are aliphatic, mono-functional (saturated, unsaturated, or multi-unsaturated) organic acids, particularly those having fewer than 36 carbon atoms. Also salts of these organic acids may be employed. Fatty acids or fatty acid salts are preferred. The salts may be any of a wide variety, particularly including the barium, lithium, sodium, zinc, bismuth, potassium, strontium, magnesium or calcium salts of the organic acids. Particular organic acids useful in the present invention include caproic acid, caprylic acid, capric acid, lauric acid, stearic acid, behenic acid, erucic acid, oleic acid, and linoleic acid.

The optional filler component is chosen to impart additional density to blends of the previously described components, the selection being dependent upon the different parts (e.g., cover, mantle, core, center, intermediate layers in a multilayered core or ball) and the type of golf ball desired (e.g., one-piece, two-piece, three-piece or multiple-piece ball), as will be more fully detailed below.

Generally, the filler will be inorganic having a density greater than about 4 grams/cubic centimeter ($g/cm^3$), preferably greater than 5 $g/cm^3$, and will be present in amounts between 0 to about 60 wt. % based on the total weight of the composition. Examples of useful fillers include zinc oxide, barium sulfate, lead silicate and tungsten carbide, as well as the other well-known fillers used in golf balls. It is preferred that the filler materials be non-reactive or almost non-reactive and not stiffen or raise the compression nor reduce the coefficient of restitution significantly.

Additional optional additives useful in the practice of the subject invention include acid copolymer wax (e.g., Allied wax AC 143 believed to be an ethylene/16-18% acrylic acid copolymer with a number average molecular weight of 2,040), which assist in preventing reaction between the filler materials (e.g., ZnO) and the acid moiety in the ethylene copolymer. Other optional additives include $TiO_2$, which is used as a whitening agent; optical brighteners; surfactants; processing aids; etc.

Ionomeric materials (HNP-type or otherwise) may be blended with conventional ionomeric copolymers (di-, ter-, etc.), using well-known techniques, to manipulate product properties as desired. The blends would still exhibit lower hardness and higher resilience when compared with blends based on conventional ionomers.

Also, ionomers can be blended with non-ionic thermoplastic resins to manipulate product properties. The non-ionic thermoplastic resins would, by way of non-limiting illustrative examples, include thermoplastic elastomers, such as polyurethane, poly-ether-ester, poly-amide-ether, polyether-urea, PEBBA® (a family of block copolymers based on polyether-block-amide, commercially supplied by Atochem), styrene-butadiene-styrene (SBS) block copolymers, styrene(ethylene-butylene)-styrene block copolymers, etc., poly amide (oligomeric and polymeric), polyesters, polyolefins including PE, PP, E/P copolymers, etc., ethylene copolymers with various comonomers, such as vinyl acetate, (meth)acrylates, (meth)acrylic acid, epoxy-functionalized monomer, CO, etc., functionalized polymers with maleic anhydride grafting, epoxidization etc., elastomers, such as EPDM, metallocene catalyzed PE and copolymer, ground up powders of the thermoset elastomers, etc. Such thermoplastic blends comprise about 1% to about 99% by weight of a first thermoplastic and about 99% to about 1% by weight of a second thermoplastic.

Additionally, the compositions of U.S. Pat. Nos. 6,953,820 and 6,653,382, both of which are incorporated herein in their entirety, discuss compositions having high COR when formed into solid spheres.

The HNP thermoplastic compositions of this invention preferably comprises (a) aliphatic, mono-functional organic acid(s) having fewer than 36 carbon atoms; and (b) ethylene, $C_3$ to $C_8$ α,β-ethylenically unsaturated carboxylic acid copolymer(s) and ionomer(s) thereof, wherein greater than 90%, preferably near 100%, and more preferably 100% of all the acid of (a) and (b) are neutralized.

The FNP thermoplastic compositions described above preferably comprise melt-processible, highly-neutralized (greater than 90%, preferably near 100%, and more preferably 100%) polymer of (1) ethylene, $C_3$ to $C_8$ a,β-ethylenically unsaturated carboxylic acid copolymers that have their crystallinity disrupted by addition of a softening monomer or other means such as high acid levels, and (2) non-volatile, non-migratory agents such as organic acids (or salts) selected for their ability to substantially or totally suppress any remaining ethylene crystallinity. Agents other than organic acids (or salts) may be used.

It has been found that, by modifying an acid copolymer or ionomer with a sufficient amount of specific organic acids (or salts thereof); it is possible to highly neutralize the acid copolymer without losing processibility or properties such as elongation and toughness. The organic acids employed in the present invention are aliphatic, mono-functional, saturated or unsaturated organic acids, particularly those having fewer than 36 carbon atoms, and particularly those that are non-volatile and non-migratory and exhibit ionic array plasticizing and ethylene crystallinity suppression properties.

With the addition of sufficient organic acid, greater than 90%, nearly 100%, and preferably 100% of the acid moieties in the acid copolymer from which the ionomer is made can be neutralized without losing the processibility and properties of elongation and toughness.

The melt-processible, highly-neutralized acid copolymer ionomer can be produced by the following:

(a) melt-blending (1) ethylene a,β-ethylenically unsaturated $C_{3-8}$ carboxylic acid copolymer(s) or melt-processible ionomer(s) thereof (ionomers that are not neutralized to the level that they have become intractable, that is not melt-processible) with (1) one or more aliphatic, mono-functional, saturated or unsaturated organic acids having fewer than 36 carbon atoms or salts of the organic acids, and then concurrently or subsequently (b) Adding a sufficient amount of a cation source to increase the level of neutralization all the acid moieties (including those in the acid copolymer and in the organic acid) to greater than 90%, preferably near 100%, more preferably to 100%.

Preferably, highly-neutralized thermoplastics of the invention can be made by:

(a) melt-blending (1) ethylene, a,β-ethylenically unsaturated $C_{3-8}$ carboxylic acid copolymer(s) or melt-processible ionomer(s) thereof that have their crystallinity disrupted by addition of a softening monomer or other means with (2) sufficient non-volatile, non-migratory agents to substantially remove the remaining ethylene crystallinity, and then concurrently or subsequently (b) adding a sufficient amount of a cation source to increase the level of neutralization all the acid moieties (including those in the acid copolymer and in the organic acid if the non-volatile, non-migratory agent is an organic acid) to greater than 90%, preferably near 100%, more preferably to 100%.

The acid copolymers used in the present invention to make the ionomers are preferably 'direct' acid copolymers. They are preferably alpha olefin, particularly ethylene, $C_{3-8}$ a,β-ethylenically unsaturated carboxylic acid, particularly acrylic and methacrylic acid, copolymers. They may optionally contain a third softening monomer. By "softening," it is meant that the crystallinity is disrupted (the polymer is made less crystalline). Suitable "softening" co-monomers are monomers selected from alkyl acrylate, and alkyl methacrylate, wherein the alkyl groups have from 1-8 carbon atoms.

The intermediate layers of the present invention may, optionally, comprise a durable, low deformation material such as metal, rigid plastics, or polymers re-enforced with high strength organic or inorganic fillers or fibers, or blends or composites thereof, as discussed below. Suitable plastics or polymers include, but not limited to, high cis- or trans-polybutadiene, one or more of partially or fully neutralized ionomers including those neutralized by a metal ion source wherein the metal ion is the salt of an organic acid, polyolefins including polyethylene, polypropylene, polybutylene and copolymers thereof including polyethylene acrylic acid or methacrylic acid copolymers, or a terpolymer of ethylene, a softening acrylate class ester such as methyl acrylate, n-butyl-acrylate or iso-butyl-acrylate, and a carboxylic acid such as acrylic acid or methacrylic acid (e.g., terpolymers including polyethylene-methacrylic acid-n or iso-butyl acrylate and polyethylene-acrylic acid-methyl acrylate, polyethylene ethyl or methyl acrylate, polyethylene vinyl acetate, polyethylene glycidyl alkyl acrylates). Suitable polymers also include metallocene catalyzed polyolefins, polyesters, polyamides, non-ionomeric thermoplastic elastomers, copolyether-esters, copolyether-amides, EPR, EPDM, thermoplastic or thermosetting polyurethanes, polyureas, polyurethane ionomers, epoxies, polycarbonates, polybutadiene, polyisoprene, and blends thereof. In the case of metallocenes, the polymer may be cross-linked with a free radical source, such as peroxide, or by high radiation. Suitable polymeric materials also include those listed in U.S. Pat. Nos. 6,187,864, 6,232,400, 6,245,862, 6,290,611, 6,142,887, 5,902,855 and 5,306,760 and in PCT Publication Nos. WO 01/29129 and WO 00/23519.

Preferably, when the intermediate layer is made with polybutadiene or other synthetic and natural rubber, the rubber composition is highly cross-linked with at least 50 phr of a suitable co-reaction agent, which includes a metal salt of diacrylate, dimethacrylate or mono methacrylate. Preferably, the co-reaction agent is zinc diacrylate. Highly crosslinked rubber compounds are discussed in commonly owned co-pending patent application entitled "Golf Ball and Method for Controlling the Spin Rate of Same" bearing application Ser. No. 10/178,580 filed on Jul. 20, 2002. This discussion is incorporated herein by reference.

If desired, the golf ball can include highly rigid materials, such as certain metals, which include, but are not limited to, tungsten, steel, titanium, chromium, nickel, copper, aluminum, zinc, magnesium, lead, tin, iron, molybdenum and alloys thereof. Suitable highly rigid materials include those listed in U.S. Pat. No. 6,244,977. Fillers with very high specific gravity such as those disclosed in U.S. Pat. No. 6,287,217 can also be incorporated into the inner core. Suitable fillers and composites include, but not limited to, carbon including graphite, glass, aramid, polyester, polyethylene, polypropylene, silicon carbide, boron carbide, natural or synthetic silk.

In accordance to one embodiment of the present invention, the golf ball comprises at least two core layers, an innermost core and an outer core, and a cover. Preferably, outer core comprises a flexible, low compression, high COR rubber composition discussed above, and inner core comprises a low deformation material discussed above. The hard, low deformation inner core resists deformation at high club speeds to maintain the COR at an optimal level, while the resilient outer layer provides high COR at slower club speeds and the requisite softness for short iron club play. The inventive ball, therefore, enjoys high initial velocity and high COR at high and low club head speeds associated, while maintaining a desirable soft feel and soft sound for greenside play.

Other rubber compounds for outer core may also include any low compression, highly resilient polymers comprising natural rubbers, including cis-polyisoprene, trans-polyisoprene or balata, synthetic rubbers including 1,2-polybutadiene, cis-polybutadiene, trans-polybutadiene, polychloroprene, poly(norbomene), polyoctenamer and polypentenamer among other diene polymers. Outer core may comprise a plurality of layers, e.g., a laminate, where several thin flexible layers are plied or otherwise adhered together.

Preferably, the rigid inner core, if present, has a flexural modulus in the range of about 25,000 psi to about 250,000 psi. More preferably, the flexural modulus of the rigid inner core is in the range of about 75,000 psi to about 225,000 psi, and most preferably in the range of about 80,000 psi to about 200,000 psi. Furthermore, the rigid inner core has durometer hardness in the range of greater than about 70 on the Shore C scale. The compression of the rigid inner core is preferably in the range of greater than about 60 PGA or Atti. More preferably, the compression is greater than about 70, and most preferably greater than about 80. Shore hardness is measured according to ASTM D-2240-00, and flexural modulus is measured in accordance to ASTM D6272-98 about two weeks after the test specimen are prepared.

Preferably, the outer core is softer and has a lower compression than the inner core. Preferably, outer core has a flexural modulus of about 500 psi to about 25,000 psi. More preferably, the flexural modulus is less than about 15,000 psi. The outer core preferably has a hardness of about 25 to about 70 on the Shore C scale. More preferably, the hardness is less than 60 on the Shore C scale.

One preferred way to achieve the difference in hardness between the inner core and the outer core is to make the inner core from un-foamed polymer, and to make the outer core from foamed polymer selected from the suitable materials disclosed herein. Alternatively, the outer core may be made from these suitable materials having their specific gravity reduced. In this embodiment the inner and outer core can be made from the same polymer or polymeric composition.

Preferably, outer core layer has a thickness from about 0.001 inches to about 0.1 inches, preferably from bout 0.01 inches to about 0.08 inches and more preferably from about 0.03 inches to about 0.05 inches. Preferably, the overall core diameter is less than about 1.50 inches, preferably less than about 1.45 inches, and more preferably about 0.5 inches to about 1.4 inches. The inner core may have any dimension so long as the overall core diameter has the preferred dimensions listed above.

The cover should be tough, cut-resistant, and selected from conventional materials used as golf ball covers based on the desired performance characteristics. The cover may be comprised of one or more layers, such as an outer cover layer and an inner cover layer. Cover materials such as ionomer resins, blends of ionomer resins, and thermoplastic or thermoset urethanes and urea can be used as known in the art.

The cover is preferably a resilient, non-reduced specific gravity layer. Suitable materials include any material that allows for tailoring of ball compression, coefficient of restitution, spin rate, etc. and are disclosed in U.S. Pat. Nos. 6,419,535, 6,152,834, 5,919,100 and 5,885,172. Jonomers, ionomer blends, thermosetting or thermoplastic polyurethanes, metallocenes, polyurethanes and polyureas (and hybrids thereof), are the preferred materials. The cover can be manufactured by a casting method, reaction injection molded, injected or compression molded, sprayed or dipped method. Preferably the cover is cast about the core, more preferably the cover is cast about the thick intermediate layer and comprises polyurea.

In a preferred embodiment, the golf ball includes an intermediate layer, as either an outer core layer or an inner cover, in addition to the outer cover. As disclosed in the U.S. Pat. Nos. 5,885,172 and 6,132,324, which are incorporated herein by reference in their entireties, outer cover layer is made from a soft thermoset material, such as cast polyurethane or polyurea, and inner cover is made from an ionomeric material, preferably including at least two ionomers.

When the intermediate layer is an inner cover layer, it is preferably formed from a high flexural modulus material which contributes to the low spin, distance characteristics of the presently claimed balls when they are struck for long shots (e.g. driver or long irons). Specifically, the inner cover layer materials have a Shore D hardness of about 55 or greater, preferably about 55-70 and most preferably about 60-70. The flexural modulus of intermediate cover layer is at least about 50,000 psi, preferably about 50,000 psi to about 150,000 psi and most preferably about 75,000 psi to about 125,000 psi. In the preferred embodiment, the intermediate layer has a thickness of from about 0.1 inches to about 0.5 inches, more preferably between about 0.11 inches and about 0.12 inches, and most preferably between about 0.115 inches and about 0.119 inches. In another thin-layer embodiment, he thickness of the intermediate layer can range from about 0.020 inches to about 0.045 inches, preferably about 0.030 inches to about 0.040 inches and most preferably about 0.035 inches.

The outer cover layer is formed preferably from a relatively soft thermoset material in order to replicate the soft feel and high spin play characteristics of a balata ball for "short game" shots. In particular, the outer cover layer should have Shore D hardness of less than 65 or from about 20 to about 65, preferably about 30 to about 60, and most preferably about 35 to about 50. Additionally, the materials of the outer cover layer must have a degree of abrasion resistance in order to be suitable for use as a golf ball cover. The outer cover layer of the present invention can comprise any suitable thermoset or thermoplastic material, preferably which is formed from a castable reactive liquid material. The preferred materials for the outer cover layer include, but are not limited to, thermoset urethanes and ureas, thermoset urethane ionomers and thermoset urethane epoxies. Examples of suitable polyurethane ionomers are disclosed in U.S. Pat. No. 5,692,974, the disclosure of which is hereby incorporated by reference in its entirety in the present application. Thermoset polyurethanes and polyureas are preferred for the outer cover layers of the balls of the present invention. Most preferably the outer cover is a cast urea material.

In accordance with another embodiment of the present invention, the golf ball comprises a relatively small, low compression, high COR inner core. The diameter of the inner core (or center) is preferably less than 1.40 inches or smaller, more preferably about 0.25 inches to about 1.25 inches, and most preferably from about 0.5 inches to about 1.0 inches. The desired thickness of either the core (center) or intermediate layer can be selected in conjunction with the flexural modulus of the material of the layers and the desired overall compression of the ball and deformation of the ball.

In another embodiment, inner core is formed from a rubber composition containing a halogenated thiophenol compound, such as described above. Other suitable polymers for inner core include a polyethylene copolymer, EPR, EPDM, a metallocene catalyzed polymer or any of the materials discussed above in connection with outer core discussed above, so long as the preferred compression, hardness and COR are met. The rubber compounds disclosed herein are preferably a high cis- or trans-polybutadiene and have a viscosity of about 40 Mooney to about 60 Mooney. Most preferably the rubber compositions are high-cis. The core has a hardness of greater than about 70 on the Shore C scale, and preferably greater than 80 on the Shore C scale. The core also has an Atti compression of less than about 60, and more preferably less than about 50. The resulting core exhibits a COR of at least about 0.730, more preferably at least 0.800, and most preferably at least about 0.810, when measured at an incoming velocity of 125 ft/s.

Preferably, the intermediate layer is made from a low deformation polymeric material, such as an ionomer, including low and high acid ionomer, any partially or fully neutralized ionomer or any thermoplastic or thermosetting polymer. The intermediate layer preferably has a flexural modulus of about 10,000 psi or greater, more preferably about 10,000 psi to about 100,000 psi, most preferably about 50,000 psi to about 75,000 psi. Among the preferred materials are hard, high flexural modulus ionomer resins and blends thereof. Additionally, other suitable mantle materials (as well as core and cover materials) are disclosed in U.S. Pat. No. 5,919,100 and international publications WO 00/23519 and WO 01/29129. These disclosures are incorporated by reference herein in their entireties. One particularly suitable material disclosed in WO 01/29129 is a melt processible composition comprising a highly neutralized ethylene copolymer and one or more aliphatic, mono-functional organic acids having fewer than 36 carbon atoms of salts thereof, wherein greater than 90% of all the acid of the ethylene copolymer is neutralized.

These ionomers are obtained by providing a cross metallic bond to polymers of monoolefin with at least one member selected from the group consisting of unsaturated mono- or di-carboxylic acids having 3 to 12 carbon atoms and esters thereof (the polymer contains 1 to 50% by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0-50 weight percent of the polymer (preferably 0-25 wt. %, most preferably 0-20 wt. %), and Y is acrylic or methacrylic acid present in 5-35 weight percent of the polymer (preferably at least about 16 wt. %, more preferably at least about 16-35 16 wt. %, most preferably at least about 16-20 16 wt. %), wherein the acid moiety is neutralized 1-90% (preferably at least 40%, most preferably at least about 60%) to form an ionomer by a cation such as lithium*, sodium*, potassium, magnesium*, calcium, barium, lead, tin, zinc* or aluminum (*=preferred), or a combination of such cations. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers.

The manner in which the ionomers are made is well known in the art as described in e.g., U.S. Pat. No. 3,262,272. Such ionomer resins are commercially available from DuPont Co. under the tradename SURLYN® and from Exxon under the tradename Iotek®. Some particularly suitable SURLYNS® include SURLYN® 8140 (Na) and SURLYN® 8546 (Li), which have a methacrylic acid content of about 19%.

Golf balls of the present invention include one-piece, two-piece, multi-layer, and wound golf balls having a variety of core structures, intermediate layers, covers, and coatings. Golf ball cores may consist of a single, unitary layer, comprising the entire core from the center of the core to its outer periphery, or they may consist of a center surrounded by at least one outer core layer. The center, innermost portion of the core is preferably solid, but may be hollow or liquid-, gel-, or gas-filled. The outer core layer may be solid, or it may be a wound layer formed of a tensioned elastomeric material. Golf ball covers may also contain one or more layers, such as a double cover having an inner and outer cover layer. Optionally, additional layers may be disposed between the core and cover. In the golf balls of the present invention, at least one layer is formed from a polymer composition having a moisture vapor transmission rate of 8 g·mil/100 $in^2$/day or less and comprising a highly neutralized acid polymer. In the most preferred embodiment, the polymer composition of the present invention is present in a relatively thick (0.110 inches or greater) intermediate layer (between the cover and the core) of a multi-layer golf ball.

As used herein, "highly neutralized acid polymer" refers to the acid polymer after at least 70%, preferably at least 80%, more preferably at least 90%, even more preferably at least 95%, and even more preferably 100%, of the acid groups thereof are neutralized. By the present invention, it has been found that when an acid polymer or a partially neutralized acid polymer is neutralized to 70% or higher using a cation source which is less hydrophilic than magnesium-based cation sources traditionally used to produce HNPs, the resulting inventive HNP provides for compositions having improved moisture vapor transmission properties. For example, a polymer composition comprising an HNP, wherein the HNP is produced using a less hydrophilic cation source, can have a moisture vapor transmission rate of 8 g·mil/100 $in^2$/day or less, or 5 g·mil/100 $in^2$/day or less, or 3 g·mil/100 $in^2$/day or less, or 2 g·mil/100 $in^2$/day or less, or 1 g·mil/100 $in^2$/day or less, or less than 1 g·mil/100 $in^2$/day. As used herein, moisture vapor transmission rate (MVTR) is given in g·mil/100 $in^2$/day, and is measured at 20° C., and according to ASTM F1249-99.

"Less hydrophilic" is used herein to refer to cation sources which are less hydrophilic than conventional magnesium-based cation sources. The HNPs of the present invention are produced using one or more of such less hydrophilic cation sources. Examples of suitable less hydrophilic cation sources include, but are not limited to, silicone, silane, and silicate derivatives and complex ligands; metal ions and compounds of rare earth elements; and less hydrophilic metal ions and compounds of alkali metals, alkaline earth metals, and transition metals; and combinations thereof Particular less hydrophilic cation sources include, but are not limited to, metal ions and compounds of potassium, cesium, calcium, barium, manganese, copper, zinc, tin, and rare earth metals. Potassium-based compounds are a preferred less hydrophilic cation source, and particularly OXONE®, commercially available from E.I. DuPont de Nemours and Co. OXONE® is a monopersulfate compound wherein potassium monopersulfate is the active ingredient present as a component of a triple salt of the formula $2KHSO_5.KHSO_4.K_2SO_4$ [potassium hydrogen peroxymonosulfate sulfate (5:3:2:2)]. The amount of less hydrophilic cation source used is readily determined based on the desired level of neutralization.

The highly neutralized acid polymers of the present invention are salts of homopolymers and copolymers of α,β-ethylenically unsaturated mono- or dicarboxylic acids, and combinations thereof. The term "copolymer," as used herein, includes polymers having two types of monomers, those having three types of monomers, and those having more than three types of monomers. Preferred acids are (meth) acrylic acid, ethacrylic acid, maleic acid, crotonic acid, fumaric acid, itaconic acid. (Meth) acrylic acid is particularly preferred. As used herein, "(meth) acrylic acid" means methacrylic acid and/or acrylic acid. Likewise, "(meth) acrylate" means methacrylate and/or acrylate. Preferred acid polymers are copolymers of a $C_3$ to $C_8$ α,β-ethylenically unsaturated mono- or dicarboxylic acid and ethylene or a $C_3$ to $C_6$ α-olefin, optionally including a softening monomer. Particularly preferred acid polymers are copolymers of ethylene and (meth) acrylic acid.

When a softening monomer is included, the acid polymer is referred to herein as an E/X/Y-type copolymer, wherein E is ethylene, X is a $C_3$ to $C_8$ α,β-ethylenically unsaturated mono- or dicarboxylic acid, and Y is a softening monomer. The softening monomer is typically an alkyl (meth) acrylate, wherein the alkyl groups have from 1 to 8 carbon atoms. Preferred E/X/Y-type copolymers are those wherein X is (meth) acrylic acid and/or Y is selected from (meth) acrylate, n-butyl (meth) acrylate, isobutyl (meth) acrylate, methyl (meth) acrylate, and ethyl (meth) acrylate. More preferred E/X/Y-type copolymers are ethylene/(meth) acrylic acid/n-butyl acrylate, ethylene/(meth) acrylic acid/methyl acrylate, and ethylene/(meth) acrylic acid/ethyl acrylate.

The amount of ethylene or $C_3$ to $C_6$ α-olefin in the acid copolymer is typically at least 15 wt %, preferably at least 25 wt %, more preferably least 40 wt %, and even more preferably at least 60 wt %, based on the total weight of the copolymer. The amount of $C_3$ to $C_8$ α,β-ethylenically unsaturated mono- or dicarboxylic acid in the acid copolymer is typically from 1 wt % to 35 wt %, preferably from 4 wt % to 35 wt %, more preferably from 6 wt % to 35 wt %, and even more preferably from 8 wt % to 20 wt %, based on the total weight of the copolymer. The amount of optional softening comonomer in the acid copolymer is typically from 0 wt % to 50 wt %.

Suitable acid polymers also include partially neutralized acid polymers. Examples of suitable partially neutralized acid polymers include, but are not limited to, SURLYN® ionomers, commercially available from E.I. DuPont de Nemours and Co.; AClyn® ionomers, commercially available from Honeywell International, Inc.; and Iotek® ionomers, commercially available from ExxonMobil Chemical Co. Additional suitable acid polymers are more fully described, for example, in U.S. Pat. No. 6,953,820 and U.S. Patent Application Publication No. 2005/0049367, the entire disclosures of which are hereby incorporated herein by reference.

The acid polymers of the present invention can be direct copolymers wherein the polymer is polymerized by adding all monomers simultaneously, as described in, for example, U.S. Pat. No. 4,351,931, the entire disclosure of which is hereby incorporated herein by reference. Ionomers can be made from direct copolymers, as described in, for example, U.S. Pat. No. 3,264,272 to Rees, the entire disclosure of which is hereby incorporated herein by reference. Alternatively, the acid polymers of the present invention can be graft copolymers wherein a monomer is grafted onto an existing polymer, as described in, for example, U.S. Patent Application Publication No. 2002/0013413, the entire disclosure of which is hereby incorporated herein by reference.

Compositions of the present invention, which are preferably for intermediate layers, include at least one inventive HNP (i.e., produced using a less hydrophilic cation source), and optionally include one or more additional INP(s). When included, the additional HNP(s) can be one or more inventive HNP(s) and/or one or more conventional HNP(s) (i e., produced using a conventional cation source). The total amount of HNP(s) in the composition is preferably at least 30 wt %, more preferably at least 50 wt %, even more preferably from 50 wt % to 99.5 wt %, and even more preferably from 60 wt % to 98 wt %, based on the total polymeric weight of the composition. Preferably, the amount of inventive ImP(s) present in the composition is at least 30 wt %.

In order to be processable, the INP-containing composition of the present invention has a melt flow index of at least 0.5 g/10 min. Preferably, the melt flow index of the HNP-containing composition is from 0.5 g/10 min to 10.0 g/10 min, more preferably from 1.0 g/10 min to 5.0 g/10 min, and even more preferably from 1.0 g/10 min to 4.0 g/10 min.

Compositions of the present invention may, optionally, contain one or more melt flow modifier(s). Suitable melt flow modifiers include organic acids and salts thereof, polyamides, polyesters, polyacrylates, polyurethanes, polyethers, thermoplastic polyureas, polyhydric alcohols, and combinations thereof Suitable organic acids are aliphatic organic acids, aromatic organic acids, saturated mono-functional organic acids, unsaturated monofunctional organic acids, multi-unsaturated mono-functional organic acids, and dimerized derivatives thereof Particular examples of suitable organic acids include, but are not limited to, caproic acid, caprylic acid, capric acid, lauric acid, stearic acid, behenic acid, erucic acid, oleic acid, linoleic acid, myristic acid, benzoic acid, palmitic acid, phenylacetic acid, naphthalenoic acid, dimerized derivatives thereof. When one or more organic acid salt(s) are included in compositions of the present invention, the cation source used to produce the organic acid salt(s) is preferably a less hydrophilic cation source. Suitable organic acids are more fully described, for example, in U.S. Pat. No. 6,756,436, the entire disclosure of which is hereby incorporated herein by reference.

Additional non-fatty acid melt flow modifiers, suitable for use in compositions of the present invention, include those described in co-pending U.S. patent application Ser. Nos. 11/216,725 and 11/216,726, the entire disclosures of which are hereby incorporated herein by reference.

Compositions of the present invention may optionally contain one or more additives in an amount of from 0 wt % to 60 wt %, based on the total weight of the composition. Suitable additives include, but are not limited to, chemical blowing and foaming agents, optical brighteners, coloring agents, fluorescent agents, whitening agents, UV absorbers, light stabilizers, defoaming agents, processing aids, mica, talc, nano-fillers, antioxidants, stabilizers, softening agents, fragrance components, plasticizers, impact modifiers, $TiO_2$, acid copolymer wax, surfactants, and fillers, such as zinc oxide, tin oxide, barium sulfate, zinc sulfate, calcium oxide, calcium carbonate, zinc carbonate, barium carbonate, clay, tungsten, tungsten carbide, silica, lead silicate, regrind (recycled material), and mixtures thereof. Suitable additives are more fully described in, for example, U.S. Patent Application Publication No. 2003/0225197, the entire disclosure of which is hereby incorporated herein by reference.

Intermediate layer compositions may, optionally, be produced by blending the HNP of the present invention with one or more additional polymers, such as thermoplastic polymers and elastomers. Examples of thermoplastic polymers suitable for blending with the invention EINPs include, but are not limited to, polyolefins, polyamides, polyesters, polyethers, polycarbonates, polysulfones, polyacetals, polylactones, acrylonitrile-butadiene-styrene resins, polyphenylene oxide, polyphenylene sulfide, styrene-acrylonitrile resins, styrene maleic anhydride, polyimides, aromatic polyketones, ionomers and ionomeric precursors, acid copolymers, conventional HNPs, polyurethanes, grafted and non-grafted metallocene-catalyzed polymers, single-site catalyst polymerized polymers, high crystalline acid polymers, cationic ionomers, and combinations thereof Particular polyolefins suitable for blending include one or more, linear, branched, or cyclic, $C_2$-$C_{40}$ olefins, particularly polymers comprising ethylene or propylene copolymerized with one or more $C_2$-$C_{40}$ olefins, $C_3$-$C_{20}$ $\alpha$-olefins, or $C_3$-$C_{10}$ $\alpha$-olefins. Particular conventional HNPs suitable for blending include, but are not limited to, one or more of the HNPs disclosed in U.S. Pat. Nos. 6,756,436; 6,894,098; and 6,953,820; the entire disclosures of which are hereby incorporated herein by reference. Examples of elastomers suitable for blending with the invention polymers include all natural and synthetic rubbers, including, but not limited to, ethylene propylene rubber ("EPR"), ethylene propylene diene rubber ("EPDM"), styrenic block copolymer rubbers (such as SI, SIS, SB, SBS, SIBS, and the like, where "S" is styrene, "I" is isobutylene, and "B" is butadiene), butyl rubber, halobutyl rubber, copolymers of isobutylene and p-alkylstyrene, halogenated copolymers of isobutylene and p-alkylstyrene, natural rubber, polyisoprene, copolymers of butadiene with acrylonitrile, polychloroprene, alkyl acrylate rubber, chlorinated isoprene rubber, acrylonitrile chlorinated isoprene rubber, and polybutadiene rubber (cis and trans). Additional suitable blend polymers include those described in U.S. Pat. No. 5,981,658, for example at column 14, lines 30 to 56, the entire disclosure of which is hereby incorporated herein by reference. The blends described herein may be produced by post-reactor blending, by connecting reactors in series to make reactor blends, or by using more than one catalyst in the same reactor to produce multiple species of polymer. The polymers may be mixed prior to being put into an extruder, or they may be mixed in an extruder.

The intermediate layer compositions of the present invention typically have a flexural modulus of from 3,000 psi to 200,000 psi, preferably from 5,000 psi to 150,000 psi, more preferably from 10,000 psi to 125,000 psi, and even more preferably from 50,000 psi to 75,000 psi. The material hardness of the composition is generally from 30 Shore D to 80 Shore D. In embodiments wherein the composition is present in a golf ball center, the composition preferably has a material hardness of from 30 Shore D to 50 Shore D. In embodiments wherein the composition is present in a golf ball cover layer, an outer core layer, or an intermediate layer disposed between the core and the cover, the composition preferably has a material hardness of from 30 Shore D to 70 Shore D. The notched izod impact strength of the compositions of the present invention is generally at least 2 ft-lb/in, as measured at 23° C. according to ASTM D-256.

The present invention is not limited by any particular method or any particular equipment for making the composition. In a preferred embodiment, the composition is prepared by the following process. An acid polymer, preferably ethylene/(meth) acrylic acid, is fed into a melt extruder, such as a single or twin screw extruder. A suitable amount of a less hydrophilic cation source is added to the molten acid polymer. The acid polymer may be partially neutralized prior to contact with the cation source, preferably with a cation source selected from metal ions and compounds of calcium, magnesium, and zinc. The acid polymer/cation mixture is intensively mixed prior to being extruded as a strand from the die-head. Optionally, a less hydrophilic cation source based on a fatty acid salt or other non-fatty acid salt melt flow modifier is incorporated during the HNP production. In a particular aspect of this embodiment, the ethylene/(meth) acrylic acid copolymer is selected from NUCREL® acid copolymers, commercially available from E.I. DuPont de Nemours and Co. (such as NUCREL® 960, an ethylene/methacrylic acid copolymer) and PRIMACOR® polymers, commercially available from Dow Chemical Co. (such as PRIMACOR® XUS 60758.08L and XUS60751.18, ethylene/acrylic acid copolymers containing 13.5% and 15.0% acid, respectively).

Another suitable material for intermediate layers (thick intermediate layers disposed between the core and cover or, alternatively, as an inner cover layer, typically relatively thin) is a high stiffness, highly neutralized ionomer having a durometer hardness of at least about 50 on the Shore D scale and a flexural modulus of at least 50,000 psi. The flexural modulus ranges from about 50,000 psi to about 150,000 psi. The hardness ranges from about 55 to about 80 Shore D, more preferably about 55 to about 70 Shore D. This ionomer, preferably at least two ionomers, may be blended with a lowly neutralized ionomers having an acid content of 5 to 25%, and may be blended with non-ionomeric polymers or compatilizers (e.g., glycidyl or maleic anhydride), so long as the preferred hardness and flexural modulus are satisfied. Examples of highly neutralized ionomers are disclosed in commonly owned, co-pending patent publication No. 2003/0013549. This sub is incorporated herein by reference.

In one preferred embodiment, this suitable material is a blend of a fatty acid salt highly neutralized polymer, such as a melt processible composition comprising a highly neutralized ethylene copolymer and one or more aliphatic, monofunctional organic acids having fewer than 36 carbon atoms of salts thereof, wherein greater than 90% of all the acid of the ethylene copolymer is neutralized, and a high stiffness partially neutralized ionomer, such as those commercially available as SURLYN® 8945, 7940, 8140 and 9120, among others. This blend has hardness in the range of about 65 to about 75 on the Shore D scale.

The intermediate layer may also comprise a laminated layer, if desired. For example, the intermediate layer may comprise a laminate comprising four layers: a polyamide layer having a flexural modulus of about 200,000 psi, a terpolymer ionomer or un-neutralized acid terpolymer having a flexural modulus of about 30,000 psi, a low acid ionomer having a flexural modulus of about 60,000 psi and a high acid ionomer having a flexural modulus of about 70,000 psi. The composite flexural modulus of the four-layer laminate is about 90,000 psi or approximately the average of the flexural modulus of the four layers, assuming that the thickness of each layer is about the same.

In a preferred embodiment, inner core, if present, has a diameter of about 0.800 to about 1.400 inches, more preferably about 1.3 to about 1.4 inches, a compression of about 44 or less, and a COR of about 0.800. The intermediate layer comprises at least two ionomers having a flexural modulus of about 50,000 psi or higher and has a thickness of at least about 0.110 inches, preferably between about 0.11 inches and about 0.12 inches. The cover is preferably a cast polyurethane or polyurea having a hardness of about 40 to about 60 Shore D. The core compression is preferably about 44 or less, and the combination of core and intermediate layer has a compression of from about 70 to about 100.

The core preferably comprises a single solid layer. Alternatively, the core may comprise multiple layers. Preferably, its diameter is about 1.400 inches or less, more preferably between about 0.8 inches and about 1.4 inches, most preferably between about 1.3 inches and about 1.4 inches. The core has a COR of about 0.770 or greater, more preferably about 0.800 or greater, and most preferably about 0.820 or greater, so as to give the ball a COR of at least 0.800 and more preferably in the range of about 0.805 to about 0.820. In one preferred embodiment, the core has a COR of about 0.770 to about 0.810.

In a preferred embodiment, intermediate cover layer and outer cover layer are similar to the inner cover layer and the outer cover layer of cover, respectively, for progressive performance. For example, outer cover layer is made from a soft, thermosetting polymer, such as cast polyurethane, and intermediate cover layer is made from a rigid ionomer or similar composition having hardness of at least 55 on the Shore D scale and flexural modulus of at least 55,000 psi.

The total thickness the cover is preferably less than 0.125 inches. Innermost layer preferably is about 0.005 inches to about 0.100 inches thick, more preferably 0.010 inches to about 0.090 inches, and most preferably about 0.015 inches to about 0.070 inches. Intermediate cover layer preferably is about 0.010 inches to about 0.050 inches thick, and outer cover layer preferably is about 0.020 inches to about 0.040 inches thick.

Golf balls made in accordance to the present invention and disclosed above have a compression of greater than about 60 PGA, more preferably greater than about 80 and even more preferably greater than about 90 PGA. These balls exhibit COR of at least 0.80 at 125 ft/s and more preferably at least 0.81 at 125 ft's. These balls also exhibit COR of at least 0.75 at 160 ft/s and more preferably at least 0.76 at 160 ft/s.

All patents and patent applications cited in the foregoing text are expressly incorporated herein by reference in their entirety.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A golf ball comprising:

a core having a diameter of 0.5 inches to 1.4 inches, a compression of about 45 or less; and a coefficient of restitution of from 0.730 to 0.810;

a cast polyurea cover; and an intermediate layer disposed between the core and the cover, the intermediate layer having a thickness of 0.11 inches or greater and being formed from a composition comprising a highly-neutralized acid polymer having a moisture vapor transmission rate of 8 g·mil/100 $in^2$/day or less;

wherein a combination of the core and the intermediate layer results in a compression of from about 70 to about 100, and the golf ball has a coefficient of restitution of from 0.805 to 0.820 when measured at an incoming velocity of 125 ft/s and greater than 0.75 when measured at an incoming velocity of 160 ft/s, and a compression of from 75 to 105.

2. The golf ball of claim 1, wherein the core diameter is 1.3 inches to 1.4 inches.

3. The golf ball of claim 2, wherein the core diameter is 1.380 inches to 1.387 inches.

4. The golf ball of claim 1, wherein the coefficient of restitution of the core is 0.774 to 0.805.

5. The golf ball of claim 1, wherein the intermediate layer thickness is 0.115 inches to 0.119 inches.

6. The golf ball of claim 1, wherein the intermediate layer hardness is 55 Shore D to 70 Shore D.

7. The golf ball of claim 1, wherein the cast polyurea cover has a hardness of 40 Shore D to 60 Shore D.

8. The golf ball of claim 1, wherein the core comprises a halogenated thiophenol present in an amount of 0.01 pph to 5 pph.

9. The golf ball of claim 8, wherein the halogenated thiophenol is present in an amount of 2.3 pph to 5 pph.

10. The golf ball of claim 1, wherein the highly-neutralized acid polymer is neutralized by a metal cation selected from the group consisting of Na; Zn; Mg; Li; Ca; Ba; Pb; Al; and K metal cations.

11. The golf ball of claim 1, wherein a combination of the intermediate layer and the core has a coefficient of restitution of 0.810 to 0.820 when measured at an incoming velocity of 125 ft/s.

12. The golf ball of claim 1, wherein the combination of the intermediate layer and the core has a compression of 70 to 100.

13. The golf ball of claim 12, wherein the combination of the intermediate layer and the core has a compression of 72 to 90.

14. The golf ball of claim 1, wherein the core comprises a center and an outer core layer comprising a halogenated thiophenol.

15. The golf ball of claim 14, wherein the halogenated thiophenol in the outer core layer is present in an amount of 0.01 pph to 5 pph.

16. A golf ball comprising:

a core comprising a center and an outer core layer, the combination of the center and the outer core layer having a diameter of 0.5 inches to 1.4 inches, a compression of 45 or less, and a coefficient of restitution of 0.730 to 0.810;

a cast polyurea cover; and an intermediate layer disposed between the core and the cover, the intermediate layer having a thickness of 0.11 inches or greater and being formed from a composition comprising a highly neutralized acid polymer having a moisture vapor transmission rate of 8 g·mil/100 $in^2$/day or less;

wherein a combination of the core and the intermediate layer results in a compression of 70 to 100, and the golf ball has a coefficient of restitution of 0.805 to 0.820 when measured at an incoming velocity of 125 ft/s and greater than 0.75 when measured at an incoming velocity of 160 ft/s, and a compression of 75 to 105.

17. The golf ball of claim 16, wherein at least one of the center or outer core layers comprises a halogenated thiophenol.

18. A golf ball comprising:

a core having a diameter of 0.5 inches to 1.55 inches, a compression of about 45 or less; and a coefficient of restitution of from 0.730 to 0.810;

a cast polyurea cover; and an intermediate layer disposed between the core and the cover, the intermediate layer having a thickness of 0.11 inches or greater and being formed from a composition comprising a highly-neutralized acid polymer having a moisture vapor transmission rate of 8 g·mil/100 $in^2$/day or less;

wherein a combination of the core and the intermediate layer results in a compression of from about 70 to about 100, and the golf ball has a coefficient of restitution of from 0.805 to 0.820 when measured at an incoming velocity of 125 ft/s and greater than 0.75 when measured at an incoming velocity of 160 ft/s, and a compression of from 75 to 105.

* * * * *